US011220780B2

(12) United States Patent
Yang

(10) Patent No.: US 11,220,780 B2
(45) Date of Patent: Jan. 11, 2022

(54) HEAT RECYCLING DRYING MACHINE UTILIZING INLET/OUTLET AIR TEMPERATURE DIFFERENCE TO CONDENSE WATER

(71) Applicant: Tai-Her Yang, Dzan-Hwa (TW)

(72) Inventor: Tai-Her Yang, Dzan-Hwa (TW)

( * ) Notice: Subject to any disclaimer, the term of this patent is extended or adjusted under 35 U.S.C. 154(b) by 235 days.

(21) Appl. No.: 16/521,724

(22) Filed: Jul. 25, 2019

(65) Prior Publication Data

US 2019/0345663 A1 Nov. 14, 2019

Related U.S. Application Data

(62) Division of application No. 13/097,195, filed on Apr. 29, 2011, now Pat. No. 10,378,143.

(51) Int. Cl.

| | |
|---|---|
| ***D06F 58/02*** | (2006.01) |
| ***D06F 58/24*** | (2006.01) |
| ***F24F 3/153*** | (2006.01) |
| ***F26B 21/08*** | (2006.01) |

(52) U.S. Cl.

CPC ..... *D06F 58/24* (2013.01); *D06F 58/02* (2013.01); *F24F 3/153* (2013.01); *F26B 21/086* (2013.01)

(58) Field of Classification Search

CPC ..... D06F 58/24; D06F 58/26; D06F 58/10; D06F 58/206; F26B 21/08; F26B 21/086; F26B 21/02; F26B 21/022; F26B 21/04; F26B 23/10; F24F 3/147; F24F 3/153; F24F 3/14

See application file for complete search history.

(56) References Cited

U.S. PATENT DOCUMENTS

| | | | | |
|---|---|---|---|---|
| 2,380,518 | A | 7/1945 | Gottschalk et al. | |
| 4,065,253 | A | 12/1977 | Bullock | |
| 4,263,721 | A | 4/1981 | Danford | |
| 4,625,432 | A | 12/1986 | Baltes | |
| 5,136,792 | A | 8/1992 | Janecke | |
| 10,378,143 | B2 * | 8/2019 | Yang | D06F 58/24 |
| 2011/0030238 | A1 | 2/2011 | Nawrot et al. | |
| 2012/0124858 | A1 * | 5/2012 | Yang | D06F 58/26 34/524 |

FOREIGN PATENT DOCUMENTS

| | | | |
|---|---|---|---|
| DE | 102005060673 | A1 | 6/2007 |
| DE | 102008020556 | A1 | 10/2009 |

* cited by examiner

*Primary Examiner* — Tavia Sullens

(74) *Attorney, Agent, or Firm* — Bacon & Thomas, PLLC

(57) ABSTRACT

Hot air containing water is discharged from a heating space to pass through a vertically bent fluid pipeline (1035) formed by an hot air section (1030) of a water condensing pipeline structure (1029) and a vertically bent flow guiding structure (1032). Meanwhile, external inlet air having relatively low temperature is pumped through an cold air section (1031) of the water condensing pipeline structure (1029) to enable the hot air to be cooled, thereby condensing the water contained in the hot air. The condensed water is collected or flows with a first part of the hot air to pass through an hot air shunt port (1026) for being guided to an external discharging port (109). A second part of the hot air is guided by the hot air shunt port (1026) to flow towards a hot air return inlet (1022), thereby reducing the thermal energy loss and saving electric energy.

10 Claims, 5 Drawing Sheets

HEAT RECYCLING DRYING MACHINE UTILIZING INLET/OUTLET AIR TEMPERATURE DIFFERENCE TO CONDENSE WATER

This application is a divisional of U.S. patent application Ser. No. 13/097,195, filed Apr. 29, 2011.

BACKGROUND OF THE INVENTION

(a) Field of the Invention

The present invention relates to a heat recycling drying machine utilizing an inlet/outlet air temperature difference to condense water, in which hot air containing water discharged from a heating space passes through a hot air pumping inlet (111) for being pumped by an electric fluid pump (106), the pumped hot air passes through a vertically bent fluid pipeline (1035) formed by an hot air section (1030) of a pipeline structure having a water condensing function (1029) and including a vertically bent flow guiding structure (1032), while external inlet air having a relatively low temperature passes through an cold air section (1031) of the water condensing pipeline structure (1029) is pumped in, the temperature difference between the above two enabling the hot air containing water to be cooled, thereby causing water condensation. The condensed water is collected or flows with a first part of the hot air to pass through an hot air shunt port (1026) and is guided to be discharged from an external discharging port (109). A second part of the hot air passes through the vertically bent fluid pipeline (1035) formed by the hot air section of housing (1030) of the water condensing pipeline structure (1029) and the vertically bent flow guiding structure (1032), and is guided by the hot air shunt port (1026) to flow towards a returned hot air inlet (1022) to enter a cold/hot air mixing space structure (1023), where the hot air is mixed with external air then entering a fluid heating device (103) for subsequent heating, thereby reducing thermal energy loss and saving electric energy.

(b) Description of the Prior Art

A conventional drying device, e.g., a drying equipment, a drum-type clothes drying machine, a heating type dehumidifier, or a hand drying machine, often utilizes an electric fluid pump to pump external air to pass through an electric heating device for being heated before entering a heating space for drying the articles to be dried. Then, the hot air is discharged to the exterior. During operation, the hot air is not dehumidified and returned to the fluid heating device, and does not perform heat exchange with external air for the purpose of heat recycling, thereby causing thermal energy and electric energy to be wasted.

SUMMARY OF THE INVENTION

The present invention provides various kinds of drying machines, wherein an electric fluid pump is installed for pumping external air having relatively low temperature into a fluid heating device to be heated before entering a heating space for drying the articles to be dried, and wherein an inlet/outlet temperature difference water condensing and heat recycling device (102) is further installed. External air having a relatively low temperature is pumped by the electric fluid pump (106) into an cold air section (1031) of a pipeline structure having a water condensing function (1029), the relatively low temperature air then entering a cold/hot air mixing space structure (1023) from an air intake port (1021). Meanwhile, hot air that contains water is discharged from the heating space and passes through a hot air pumping inlet (111) to be pumped by the electric fluid pump (106) through a vertically bent fluid pipeline (1035) formed by an hot air section of housing (1030) of the pipeline structure having a water condensing function (1029) and past a vertically bent flow guiding structure (1032). A part of the hot air passes through a hot air shunt port (1026) and is guided by a fluid guiding surface (1020) to enter the cold/hot air mixing space structure (1023) for .preheating and being mixed with the pumped-in external air having a relatively low temperature. The mixed air then enters, in various preferred embodiments, a fluid heating device (103) for subsequent heating, thereby reducing thermal energy loss and saving electric energy. In addition, a part of hot air that passes through the hot air shunt port (1026) is discharged from an external discharging port (109). The thermal energy of the hot air passing through the vertically bent fluid pipeline (1035) formed by the hot air section of housing (1030) of the water condensing pipeline structure (1029) and the vertically bent flow guiding structure (1032) is utilized to preheat the external air having a relative low temperature passing through the cold air section (1031) of the pipeline structure (1029). The temperature difference of between the relative cold and hot air in the respective internal and external parts of housing (1030) enables the water contained in the hot air to be condensed in the hot air section of housing (1030) of the water condensing pipeline structure (1029) of the inlet/outlet temperature difference water condensing and heat recycling device (102) for being collected or discharged to the exterior.

DESCRIPTION OF MAIN COMPONENT SYMBOLS

Figure 1:
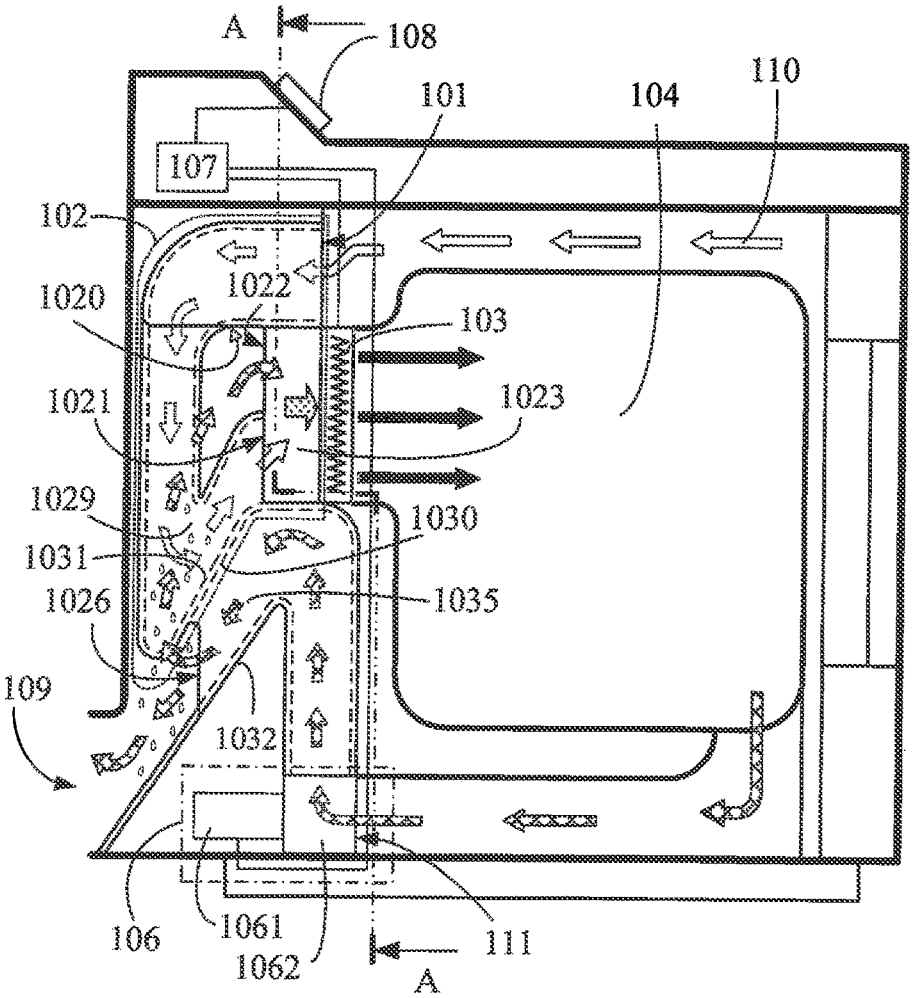
FIG. 1 a schematic view showing the main structure of the present invention.

101: Air inlet
102: Inlet/outlet temperature difference water condensing and heat refluxing device
103: Fluid heating device
104: Heating space
105: Drum driving motor set
106: Electric fluid pump
107: Electronic control device
108: External operation interface
109: External discharging port
110: Air intake flowpath
111: Hot airflow pumping inlet
200: Electrically-charged refrigeration chip
1020: Fluid guiding surface
1021: Air intake port
1022: Returned hot airflow inlet
1023: Cold/hot airflow mixing space structure
1026: Hot airflow shunt orifice
1027: Static flow unifying structure
1028: Free rotation stir blade structure
1029: Pipeline structure having water condensing function
1030: External housing part of pipeline structure having water condensing function (1029)
1031: Internal housing part of pipeline structure having water condensing function (1029)
1032: Vertically bent flow guiding structure
1035: Vertically bent fluid pipeline
1040: Drum device
1061: Fluid pumping motor
1062: Fluid pump

DETAILED DESCRIPTION OF THE PREFERRED EMBODIMENTS

A conventional drum-type drying device, e.g. a drying equipment, drum-type clothes drying machine, heating type dehumidifier or hand drying machine, often utilizes an electric fluid pump to pump external air through an electric heating device and into a heating space for drying the articles to be dried, after which the hot air is discharged to the exterior. During operation, the hot air is not dehumidified and returned to the fluid heating device, and does not perform heat exchange with the external air for the purpose of heat recycling. As a result, thermal energy and electric energy are wasted.

The present invention relates to a heat recycling drying machine utilizing inlet/outlet air temperature difference to condense water, in which hot air containing water is discharged from a heating space and passes through a hot air pumping inlet (111) for being pumped by an electric fluid pump (106), the pumped hot air passing through a vertically bent fluid pipeline (1035) formed by an hot air section (1030) of a pipeline structure having a water condensing function (1029) and a vertically bent flow guiding structure (1032). In the meantime, external air having a relatively low temperature passes through an cold air section (1031) of the water condensing pipeline structure (1029). The temperature difference between the hot air and the relatively cold air enables the hot air containing water to be cooled, and the water contained in the hot air to be condensed, the condensed water being collected or flowing with a part of the hot air to pass through a hot air shunt port (1026) and be guided for discharge through an external discharging port (109). A part of the hot air passing through the vertically bent fluid pipeline (1035) formed by the hot air section (1030) of the water condensing pipeline structure (1029) and the vertically bent flow guiding structure (1032) is guided by the hot air shunt port (1026) to flow towards a returned hot air inlet (1022) for entering a cold/hot air mixing space structure (1023). The returned hot air is preheats and then is mixed with the external air, which then enters a fluid heating device (103) for subsequent heating, thereby reducing thermal energy loss and saving electric energy.

The present invention provides various kinds of drying machines, in which an electric fluid pump is installed for pumping external air having relatively low temperature into a fluid heating device to be heated and then enter a heating space for drying the articles to be dried, and in which the drying machines are further installed with an inlet/outlet temperature difference water condensing and heat recycling device (102), wherein the external air having relatively low temperature is pumped by the electric fluid pump (106) to enter an cold air section (1031) of a pipeline structure having a water condensing function (1029), and then into a cold/hot air mixing space structure (1023) from an air intake port (1021). The hot air containing water discharged from the heating space passes through the hot air pumping inlet (111) and then is pumped by the electric fluid pump (106) through a vertically bent fluid pipeline (1035) formed by an hot air section (1030) of the water condensing pipeline structure (1029) and a vertically bent flow guiding structure (1032). A part of the hot air passes through a hot air shunt port (1026) and a fluid guiding surface (1020) and into the cold/hot air mixing space structure (1023) for preheating and being mixed with the pumped-in external air having a relatively low temperature, the mixed air then entering a fluid heating device (103) for subsequent heating, thereby reducing thermal energy loss and saving electric energy. The hot air shunt port (1026) causes a part of the hot air to be discharged from an external discharging port (109), while the thermal energy of the hot air passing through the vertically bent fluid pipeline (1035) formed by the hot air section (1030) of the water condensing pipeline structure (1029) and the vertically bent flow guiding structure (1032) is utilized to preheat the external air having relative low temperature passing through the cold air section (1031) of the water condensing pipeline structure (1029), the temperature difference between the air in the internal and external parts of the housing enabling the water contained in the hot air to be condensed in the hot air section (1030) of the water condensing pipeline structure (1029) of the inlet/outlet temperature difference water condensing and heat recycling device (102) for being collected or discharged to the exterior.

FIG. 1 a schematic view showing the main structure of the present invention.

Figure 2:
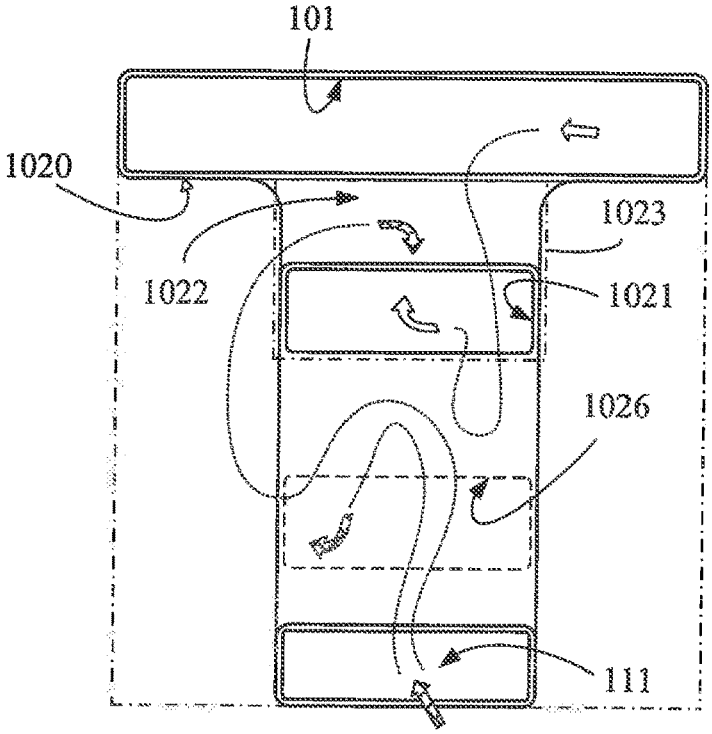
FIG. 2 is a cross view of FIG. 1 taken along an A-A line.

FIG. 2 is a cross view of FIG. 1 taken along an A-A line. As shown in FIG. 1 and FIG. 2,:

Air inlet (101), through which external air having a relatively low temperature is pumped by an electric fluid pump (106) for being introduced from the air inlet (101) to an air intake flowpath (110), the external air passing through an cold air section (1031) of a pipeline structure having a water condensing function (1029) and a cold/hot air mixing space structure (1023), and then through a fluid heating device (103) for being heated before entering a heating space (104);

Inlet/outlet temperature difference water condensing and heat recycling device (102) which has a connection port structure connected with the air intake flowpath (110), so the external air having relatively low temperature pumped in from the air inlet (101) connected to the air intake flowpath (110) is allowed to pass through the cold air section (1031) of the water condensing pipeline structure (1029) and then enters the cold/hot air mixing space structure (1023) through the air intake port (1021).

The inlet/outlet temperature difference water condensing and heat recycling device (102) includes a vertically bent fluid pipeline (1035) formed by the hot air section (1030) of the water condensing pipeline structure (1029) and a vertically bent flow guiding structure (1032) which allows the hot air discharged from the heating space (104) to pass through. A hot air shunt port (1026) and a fluid guiding surface (1020) guides a first part of the hot air passing through the vertically bent fluid pipeline (1035) to enter the cold/hot air mixing space structure (1023) through a returned hot air inlet (1022), so as to be mixed with the external air having relatively low temperature in the cold/hot air mixing space structure (1023) before entering the fluid heating device (103) for subsequent heating, while the thermal energy of the hot air flowing towards the vertically bent fluid pipeline (1035) is utilized to preheat the external air having relatively low temperature passing through the cold air section (1031) of the water condensing pipeline structure (1029).

The hot air section (1030) of the water condensing pipeline structure (1029) provides a water condensing function, with the external air having relatively low temperature passing through the cold air section (1031) of the water condensing pipeline structure (1029), and the hot air containing water discharged from the heating space (104) being pumped by the electric fluid pump (106) while entering from the hot air pumping inlet (111) to pass through the vertically bent fluid pipeline (1035), the temperature difference between the hot air in the hot air section (1032) and the relatively cold air in the cold air section (1031) enables the water contained in the hot air passing through the vertically bent fluid pipeline (1035) to be condensed in the hot air section (1030) of the water condensing pipeline structure (1029) for being collected or discharged to the exterior.

As a result of the shunting by the hot air shunt port (1026), a part of the hot air is discharged to the exterior from the external discharging port (109).

Fluid heating device (103), which is constituted by an electric heating device that utilizes electric energy to generate heat, and that is controlled by an electronic control device (107) for controlling the heating temperature and operation of ON/OFF, for re-heating the preheated and mixed air from the cold/hot air mixing space structure (1023) before the mixed air flows into the heating space (104).

Heating space (104), which includes a hot air inlet and outlet and is formed with an internal space for accommodating the articles to be dried, wherein the heating space can be a sealed space, semi-opened space or opened space. The hot air inlet of the heating space (104) allows the hot air from the fluid heating device (103) to flow in, and the hot air outlet of the heating space (104) is provided for discharging the hot air which is leaded to the hot air pumping inlet (111).

Electric fluid pump (106), installed between the heating space (104) and the vertically bent fluid pipeline (1035), wherein a fluid pumping motor (1061) is electrically charged to operate for driving a fluid pump (1062) to pump the external air having relatively low temperature to pass through the air intake flowpath (110) and the cold air section (1031) of the water condensing pipeline structure (1029). The external air then enters the cold/hot air mixing space structure (1023) through the air intake port (1021), while the hot air discharged from the heating space (104) is pumped by the electric fluid pump (106) to flow towards the hot air pumping inlet (111), and then to the vertically bent fluid pipeline (1035) and through the hot air shunt port (1026) for being shunted, so that a part of the hot air is guided by the fluid guiding surface (1020) to flow back to the cold/hot air mixing space structure (1023) through the returned hot air inlet (1022), for preheating and being mixed with the external air having relatively low temperature that has passed through the air inlet (101), the air intake flowpath (110), and the cold air section (1031) of the water condensing pipeline structure (1029) before entering the fluid heating device (103), the mixed air flowing into the heating space (104) after being re-heated by the fluid heating device (103).

A part of the hot air passing through the vertically bent fluid pipeline (1035) is shunted by the hot air shunt port (1026) for being discharged to the exterior through the external discharging port (109).

Electronic control device (107), which is constituted by the electromechanical unit or solid state electronic circuit unit and/or micro processer and operation software, for receiving electric power from a power source and receiving the settings and operations of an external operation interface (108), so as to control the operations of the fluid heating device (103) and the electric fluid pump (106).

External operation interface (108), which is constituted by the electromechanical unit or solid state electronic circuit unit and/or micro processer and operation software, for receiving manual inputs to control the electronic control device (107).

External discharging port (109), which allows the hot air passing through the vertically bent fluid pipeline (1035) of the inlet/outlet temperature difference water condensing and heat recycling device (102) to be guided by the hot air shunt port (1026) and partly discharged to the exterior from the external discharging port (109).

When being operated, the electronic control device (107) actuates the electric fluid pump (106) and the fluid heating device (103), and at this moment, the external air having relatively low temperature enters the cold air section (1031) of the water condensing pipeline structure (1029) through the air inlet (101), passes through the air intake port (1021) for entering the cold/hot air mixing space structure (1023), and then flows through the fluid heating device (103) for being heated then entering the heating space (104). Meanwhile, the hot air containing water discharged from the heating space (104) passes through the hot air pumping inlet (111), and then is pumped by the electric fluid pump (106) to flow through the vertically bent fluid pipeline (1035).

The hot air section (1030) of the water condensing pipeline structure (1029) of the inlet/outlet temperature difference water condensing and heat recycling device (102) provides the water condensing function, and the temperature difference between the external air having relatively low temperature passing through the cold air section (1031) of the water condensing pipeline structure (1029) and the hot air passing through the vertically bent fluid pipeline (1035) allows the water contained in the hot air to be condensed in the hot air section of housing (1030) of the water condensing pipeline structure (1029) for being collected or discharged to the exterior.

As a result of shunting by the hot air shunt port (1026), a first part of the hot air passing through the hot air section (1030) of the water condensing pipeline structure having water condensing part (1029) is shunted by the hot air shunt port (1026) for being discharged to the exterior from the external discharging port (109).

With the structure of the hot air shunt port (1026) and the fluid guiding surface (1020), a second part of the hot air is guided by the returned hot air inlet (1022) enters the cold/hot air mixing space structure (1023) for preheating and being mixed with the external air having relatively low temperature in the cold/hot air mixing space structure (1023). The mixed air then enters the fluid heating device (103), and when the hot air discharged from the heating space (104) passes through the vertically bent fluid pipeline (1035), the thermal energy of the hot air being utilized to preheat the external air having relatively low temperature and passing through the cold air section (1031) of the water condensing pipeline structure (1029).

Figure 3:
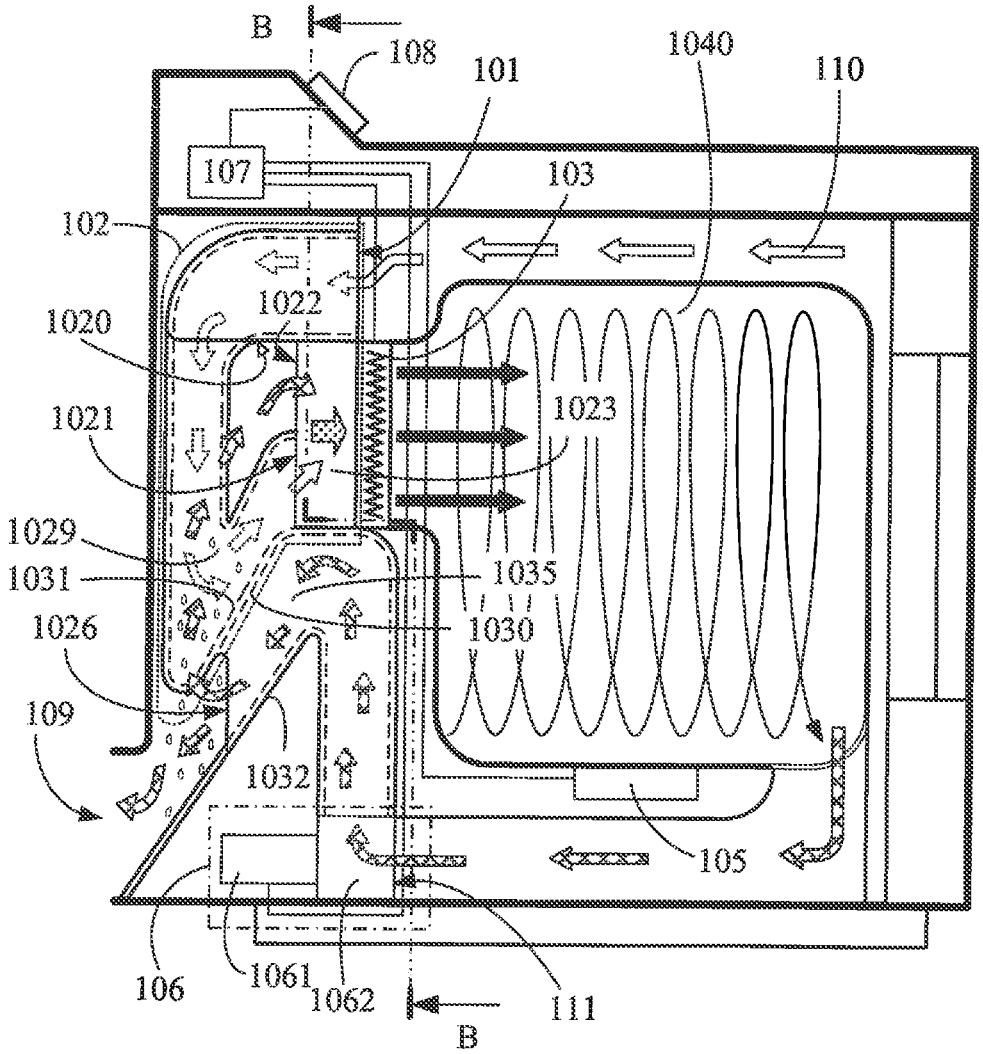
FIG. 3 is a schematic structural view showing the present invention being applied in a drum type cloth drying machine, according to one embodiment of the present invention.

FIG. 3 is a schematic structural view showing the present invention being applied in a drum type cloth drying machine, according to one embodiment of the present invention.

The cross view of FIG. 3 taken along a B-B line is the same as FIG. 2.

As shown in FIG. 3 and FIG. 2, besides the housing, electric conductive wires and a drum device driven by an electric motor, the drying device includes:

Air inlet (101), through which the external air having relatively low temperature is pumped by an electric fluid pump (106) for being introduced from the air inlet (101) to an air intake flowpath (110), the external air passing through an cold air section (1031) of the water condensing pipeline structure (1029) and a cold/hot air mixing space structure (1023), and then through a fluid heating device (103) for being heated before entering a drum device (1040).

Inlet/outlet temperature difference water condensing and heat recycling device (102), which has a connection port structure connected with the air intake flowpath (110), so that the external air having relatively low temperature pumped in from the air inlet (101) connected to the air intake flowpath (110) is allowed to pass through the cold air section (1031) of the water condensing pipeline structure (1029) and then enters the cold/hot air mixing space structure (1023) through the air intake port (1021).

Recycling device (102) also includes vertically bent fluid pipeline (1035) formed by the hot air section (1030) of the water condensing pipeline structure (1029) and an vertically bent flow guiding structure (1032) which allows the hot air discharged from the drum device (1040) to pass through and has a hot air shunt port (1026) and a fluid guiding surface (1020), with the structure of the hot air shunt port (1026) and the fluid guiding surface (1020) causing a part of the hot air passing through the vertically bent fluid pipeline (1035) to be guided by the fluid guiding surface (1020) to enter the cold/hot air mixing space structure (1023) through a returned hot air inlet (1022), so as to preheat and be mixed with the external air having relatively low temperature in the cold/hot air mixing space structure (1023) before entering the fluid heating device (103) for subsequent heating As a result, the thermal energy of the hot air flowing towards the vertically bent fluid pipeline (1035) is utilized to preheat the external air having relatively low temperature passing through the cold air section (1031) of the water condensing pipeline structure (1029).

The hot air section (1030) of the water condensing pipeline structure (1029) provides a water condensing function, with the external air having relatively low temperature passing through the cold air section (1031) of the water condensing pipeline structure (1029), and the hot air containing water discharged from the drum device (1040) being pumped by the electric fluid pump (106) while entering from the hot air pumping inlet (111) to pass through the vertically bent fluid pipeline (1035). The temperature difference between the hot air in the hot air section (1032) and the relatively cold air in the cold air section (1031) enables the water contained in the hot air passing through the vertically bent fluid pipeline (1035) to be condensed in the hot air section (1030) of the water condensing pipeline structure (1029) for being collected or discharged to the exterior.

The shunting of the hot air shunt port (1026) also causes a part of the hot air is discharged to the exterior from the external discharging port (109).

Fluid heating device (103), which is constituted by an electric heating device that utilizes electric energy to generate heat and is controlled by an electronic control device (107) for controlling the heating temperature and operation of ON/OFF, the fluid heating device (103) re-heating the preheated and mixed air from the cold/hot air mixing space structure (1023) before the mixed air flows into the drum device (1040).

Drum device (1040), which is driven by a drum driving motor set (105) composed of a driving motor and a transmission device, for operation at the set rotation speed and rotating direction, the drum device (1040) having a hot air inlet and outlet, the hot air inlet of the drum device (1040) allowing the hot air from the fluid heating device (103) to flow in, and the outlet of the drum device (1040) being provided for discharging the hot air to the hot air pumping inlet (111) of the electric fluid pump (106), the drum device (1040) being formed with a space inside for accommodating articles or clothes to be dried, and driven by the drum driving motor set (105) to rotate for uniformly receiving the drying provided by the hot air.

Drum driving motor set (105), which is constituted by an electric motor subjected to the operation of the electronic control device (107), and then via a transmission device to drive the drum device (1040) to rotate at a set rotation speed and rotating direction.

Electric fluid pump (106), which is installed between the drum device (1040) and the vertically bent fluid pipeline (1035), wherein a fluid pumping motor (1061) is electrically charged to operate for driving a fluid pump (1062) to pump the external air having relatively low temperature to pass through the air intake flowpath (110) and the cold air section (1031) of the water condensing pipeline structure (1029) and enter the cold/hot air mixing space structure (1023) through the air intake port (1021) while the hot air discharged from the drum device (1040) is pumped by the electric fluid pump (106) to flow towards the hot air pumping inlet (111) and then through the vertically bent fluid pipeline (1035) to pass the hot air shunt port (1026) for being shunted, so that a part of the hot air is guided by the fluid guiding surface (1020) to flow back to the cold/hot air mixing space structure (1023) through the returned hot air inlet (1022) for preheating and being mixed with the external air having a relatively low temperature that has passed through the air inlet (101), the air intake flowpath (110), and the cold air section (1031) of the pipeline structure (1029) before entering the fluid heating device (103), the mixed air flowing into the drum device (1040) after being re-heated by the fluid heating device (103).

A part of the mentioned hot air passing through the vertically bent fluid pipeline (1035) is shunted by the hot air shunt port (1026) for being discharged to the exterior through the external discharging port (109).

Electronic control device (107), which is constituted by the electromechanical unit or solid state electronic circuit unit and/or micro processer and operation software, for receiving the electric power from a power source and receiving the settings and operations of an external operation interface (108), so as to control the operations of the fluid heating device (103), the drum driving motor set (105) and the electric fluid pump (106).

External operation interface (108), which is constituted by the electromechanical unit or solid state electronic circuit unit and/or micro processer and operation software, for receiving manual inputs to control the electronic control device (107).

External discharging port (109), which allows the hot air passing through the vertically bent fluid pipeline (1035) of the inlet/outlet temperature difference water condensing and heat recycling device (102) to be guided by the hot air shunt port (1026) and discharged to the exterior of the drying device.

When being operated, the electronic control device (107) actuates the electric fluid pump (106), the fluid heating device (103) and the drum driving motor set (105), and at this moment, the external air having relatively low temperature enters the cold air section (1031) of the pipeline structure (1029) through the air inlet (101), and passes through the air intake port (1021) for entering the cold/hot air mixing space structure (1023) and flowing through the fluid heating device (103) for heating before entering the drum device (1040), the hot air containing water discharged from the drum device (1040) passing through the hot air pumping inlet (111) and then being pumped by the electric fluid pump (106) to flow through the vertically bent fluid pipeline (1035).

The hot air section (1030) of the water condensing pipeline structure (1029) of the inlet/outlet temperature difference water condensing and heat recycling device (102) provides a water condensing function, and the temperature difference between the external air having relatively low temperature passing through the cold air section (1031) of the water condensing pipeline structure (1029) and the hot air passing through the vertically bent fluid pipeline (1035) allows the water contained in the hot air to be condensed in the hot air section (1030) of the water condensing pipeline structure (1029) for being collected or discharged to the exterior.

The hot air shunt port (1026) shunts a first part of the hot air passing through the hot air section (1030) of the water condensing pipeline structure (1029) to the exterior to the exterior of the drying device through the external discharging port (109).

The hot air shunt port (1026) and fluid guiding surface (1020) also shunts a second part of the hot air to the returned hot air inlet (1022) for entering the cold/hot air mixing space structure (1023) for preheating and being mixed with the external air having relatively low temperature in the cold/hot air mixing space structure (1023), the mixed air then entering the fluid heating device (103). When the hot air discharged from the drum device (1040) passes through the vertically bent fluid pipeline (1035), the thermal energy of the hot air is utilized to preheat the external air having relatively low temperature and passing through the cold air section (1031) of the water condensing pipeline structure (1029).

Figure 4:
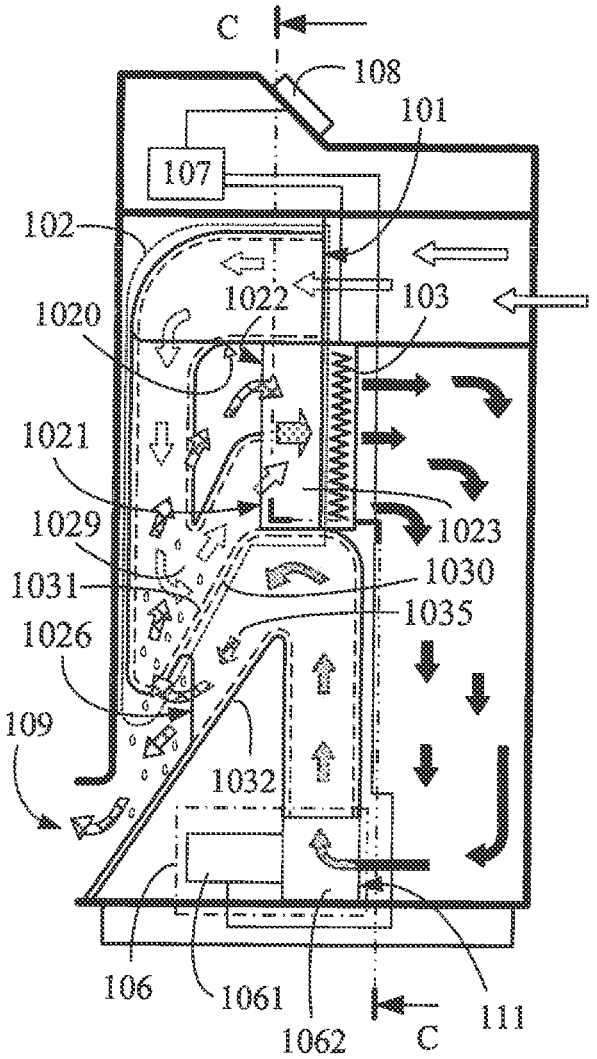
FIG. 4 is a schematic structural view showing the present invention being applied in a dehumidifier, according to one embodiment of the present invention.

FIG. 4 is a schematic structural view showing the present invention being applied in a dehumidifier, according to one embodiment of the present invention.

The cross view of FIG. 4 taken along a C-C line is the same as FIG. 2.

As shown in FIG. 4 and FIG. 2, the drying device of this embodiment includes:

Air inlet (101), through which the external air having relatively low temperature is pumped by an electric fluid pump (106) for being introduced from the air inlet (101) to an air intake flowpath (110), the external air passing through an cold air section (1031) of a water condensing pipeline structure (1029) and a cold/hot air mixing space structure (1023), and then through a fluid heating device (103) for being heated before entering the hot air pumping inlet (111) to be pumped by the electric fluid pump (106) through the vertically bent fluid pipeline (1035).

Inlet/outlet temperature difference water condensing and heat recycling device (102), which has a connection port structure connected with the air intake flowpath (110), so that the external air having relatively low temperature pumped in from the air inlet (101) connected to the air intake flowpath (110) is allowed to pass through the cold air section (1031) of the water condensing pipeline structure (1029) and then enter the cold/hot air mixing space structure (1023) through the air intake port (1021).

The vertically bent fluid pipeline (1035) formed by the hot air section (1030) of the water condensing pipeline structure (1029) and an vertically bent flow guiding structure (1032) allow the hot air discharged from the fluid heating device (103) to pass through to a hot air shunt port (1026) and a fluid guiding surface (1020). The hot air shunt port (1026) and the fluid guiding surface (1020) cause a part of the hot air passing through the vertically bent fluid pipeline (1035) and guided by the fluid guiding surface (1020) to enter the cold/hot air mixing space structure (1023) through a returned hot air inlet (1022), so as to preheat and be mixed with the external air having relatively low temperature in the cold/hot air mixing space structure (1023) before entering the fluid heating device (103) for the subsequent heating while the thermal energy of the hot air flowing towards the vertically bent fluid pipeline (1035) is utilized to preheat the external air having relatively low temperature passing through the cold air section (1031) of the water condensing pipeline structure (1029).

The hot air section (1030) of the water condensing pipeline structure (1029) provides a water condensing function, with the external air having relatively low temperature passing through the cold air section (1031) of the water condensing pipeline structure (1029), and the hot air containing water discharged from the fluid heating device (103) being pumped by the electric fluid pump (106) while entering from the hot air pumping inlet (111) to pass through the vertically bent fluid pipeline (1035). The temperature difference between the hot air in the hot air section (1032) and the relatively cold air in the cold air section (1031) enables the water contained in the hot air passing through the vertically bent fluid pipeline (1035) to be condensed in the hot air section (1030) of the water condensing pipeline structure (1029) for being collected or discharged to the exterior.

The hot air shunt port (1026) shunts a part of the hot air to the exterior through the external discharging port (109).

Fluid heating device (103), which is constituted by an electric heating device that utilizes electric energy to generate heat and that is controlled by an electronic control device (107) for controlling the heating temperature and operation of ON/OFF, the fluid heating device (103) being provided for re-heating the preheated and mixed air from the cold/hot air mixing space structure (1023) before the mixed air flows to the hot air pumping inlet (111).

Electric fluid pump (106), which is installed between the fluid heating device (103) and the vertically bent fluid pipeline (1035), wherein a fluid pumping motor (1061) is electrically charged to operate for driving a fluid pump (1062) to pump the external air having relatively low temperature to pass through the air intake flowpath (110) and the cold air section (1031) of the water condensing pipeline structure (1029) and then enter the cold/hot air mixing space structure (1023) through the air intake port (1021) while the hot air discharged from the fluid heating device (103) is pumped by the electric fluid pump (106) to flow towards the hot air pumping inlet (111), the vertically bent fluid pipeline (1035), and the hot air shunt port (1026) for being shunted, so that a part of the hot air is guided by the fluid guiding surface (1020) to flow back to the cold/hot air mixing space structure (1023) through the returned hot air inlet (1022), for preheating and being mixed with the external air having relatively low temperature passing through the air inlet (101) and the air intake flowpath (110) and the cold air section (1031) of the water condensing pipeline structure (1029) before entering the fluid heating device (103), and then flowing into the hot air pumping inlet (111) after being re-heated by the fluid heating device (103).

A part of the hot air passing through the vertically bent fluid pipeline (1035) is shunted by the hot air shunt port (1026) for being discharged to the exterior through the external discharging port (109).

Electronic control device (107), which is constituted by an electromechanical unit or solid state electronic circuit unit and/or micro processer and operation software, for receiving electric power from a power source and receiving settings and operations from an external operation interface (108), so as to control the operations of the fluid heating device (103) and the electric fluid pump (106).

External operation interface (108),which is constituted by an electromechanical unit or solid state electronic circuit unit and/or micro processer and operation software, for receiving manual inputs to control the electronic control device (107).

External discharging port (109), which allows a part of the hot air passing through the vertically bent fluid pipeline (1035) of the inlet/outlet temperature difference water condensing and heat recycling device (102) and guided by the hot air shunt port (1026) to be discharged to the exterior.

When being operated, the electronic control device (107) actuates the electric fluid pump (106) and the fluid heating device (103), and at this moment, the external air having relatively low temperature enters the cold air section (1031) of the water condensing pipeline structure (1029) through the air inlet (101), and passes through the air intake port (1021) for entering the cold/hot air mixing space structure (1023), and the hot air containing water discharged after being heated by the fluid heating device (103) enters the hot air pumping inlet (111) and then is pumped by the electric fluid pump (106) to flow through the vertically bent fluid pipeline (1035).

The hot air section (1030) of the water condensing pipeline structure (1029) of the inlet/outlet temperature difference water condensing and heat recycling device (102) provides the water condensing function, and the temperature difference between the external air having relatively low temperature passing through the cold air section (1031) of the water condensing pipeline structure (1029) and the hot air passing through the vertically bent fluid pipeline (1035) allows the water contained in the hot air to be condensed in the hot air section (1030) of the water condensing pipeline structure (1029) for being collected or discharged to the exterior for achieving the dehumidifying effect.

The hot air shunt port (1026) shunts a part of the hot air passing through the hot air section (1030) of the water condensing pipeline structure (1029) to the exterior through the external discharging port (109).

With the structure of the hot air shunt port (1026) and the fluid guiding surface (1020), a part of the hot air is guided by the returned hot air inlet (1022) to enter the cold/hot air mixing space structure (1023) for preheating and being mixed with the external air having relatively low temperature in the cold/hot air mixing space structure (1023) before entering the fluid heating device (103) for being heated. When the discharged hot air passes through the vertically bent fluid pipeline (1035), the thermal energy of the hot air is utilized to preheat the external air having relatively low temperature and passing through the cold air section (1031) of the water condensing pipeline structure (1029).

In the embodiments disclosed in FIG. 1, FIG. 2, FIG. 3 and FIG. 4, between the cold/hot air mixing space structure (1023) and the fluid heating device (103), a labyrinth type flow mixing functional structure or multiple grid flow mixing functional structure or multiple partition board flow mixing functional structure can be further installed for unifying the preheated and mixed air.

Figure 5:
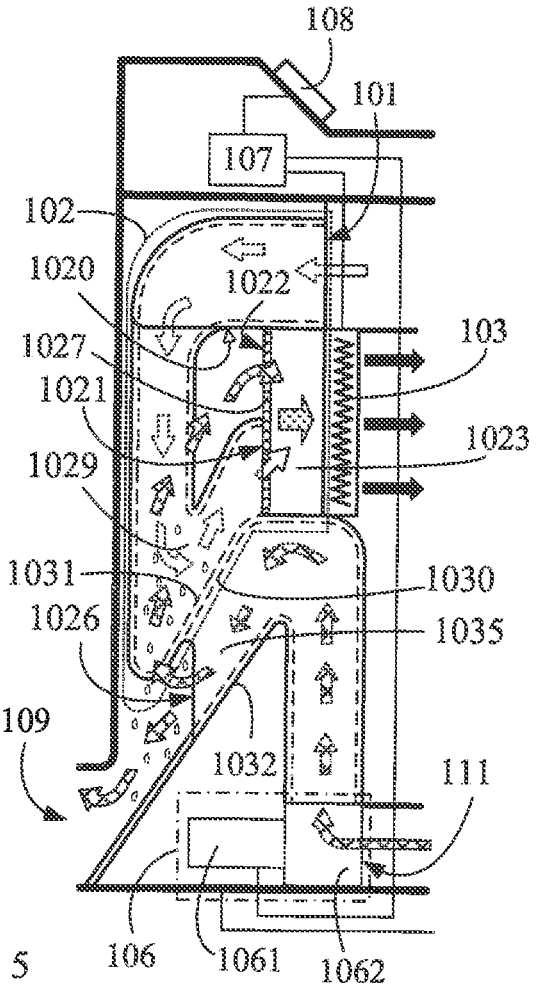
FIG. 5 is a schematic structural view showing a static flow unifying structure (1027) being installed at the outlet of the cold/hot air mixing space structure (1023), according to one embodiment of the present invention.

FIG. 5 is a schematic structural view showing a static flow unifying structure (1027) being installed at the outlet of the cold/hot air mixing space structure (1023), according to one embodiment of the present invention.

As shown in FIG. 5, in the heat recycling drying machine utilizing inlet/outlet air temperature difference to condense water, the static flow unifying structure (1027) is installed between the cold/hot air mixing space structure (1023) and the fluid heating device (103), with the labyrinth type flow mixing functional structure or multiple grid flow mixing functional structure or multiple partition board flow mixing functional structure of the static flow unifying structure (1027), so that the preheated and mixed air can be unified for flowing to the fluid heating device (103) to be re-heated.

In the embodiments disclosed in FIG. 1, FIG. 2, FIG. 3 and FIG. 4, between the cold/hot air mixing space structure (1023) and the fluid heating device (103), a free rotation stir blade structure (1028) can also be further installed, so that the preheated and mixed air is stirred and unified through the free rotation of the free rotation stir blade structure (1028).

Figure 6:
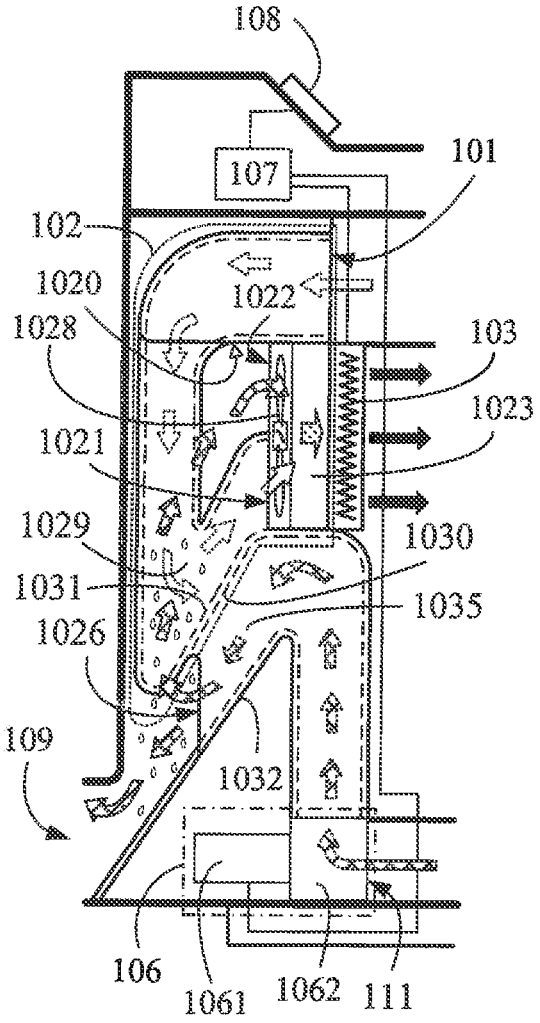
FIG. 6 is a schematic structural view showing a free rotation stir blade structure (1028) being installed at the outlet of the cold/hot air mixing space structure (1023), according to one embodiment of the present invention.

FIG. 6 is a schematic structural view showing a free rotation stir blade structure (1028) being installed at the outlet of the cold/hot air mixing space structure (1023), according to one embodiment of the present invention.

As shown in FIG. 6, in the heat recycling drying machine utilizing inlet/outlet air temperature difference to condense water of the present invention, the free rotation stir blade structure (1028) is installed between the cold/hot air mixing space structure (1023) and the fluid heating device (103). The free rotation of the free rotation stir blade structure (1028) can stir the preheated and mixed air for being unified before flowing to the fluid heating device (103) for being re-heated.

In the heat recycling drying machine utilizing inlet/outlet air temperature difference to condense water of the present invention, the static flow unifying structure (1027) and the free rotation stir blade structure (1028) can both be installed between the cold/hot air mixing space structure (1023) and the fluid heating device (103).

In the heat recycling drying machine utilizing inlet/outlet air temperature difference to condense water of the present invention, in order to increase the water condensing function to the water contained in the returned hot air passing the inlet/outlet temperature difference water condensing and heat recycling device (102), a water condensing pipeline structure (1029) of the inlet/outlet temperature difference water condensing and heat recycling device (102) can be further installed with a thermoelectric cooling chip (200) for increasing the water condensing effect of the hot air containing water passing through the hot air section of housing of the water condensing pipeline structure (1029), and for heating the external air in the cold air section of the water condensing pipeline structure (1029).

In the embodiments disclosed in FIG. 1, FIG. 2, FIG. 3 and FIG. 4, the thermoelectric cooling chip (200) may be further installed on the water condensing pipeline structure (1029), for increasing the water condensing effect to the hot air containing water passing through the hot air section of housing of the water condensing pipeline structure (1029), and for heating the external air in the cold air section of the water condensing pipeline structure (1029).

Figure 7:
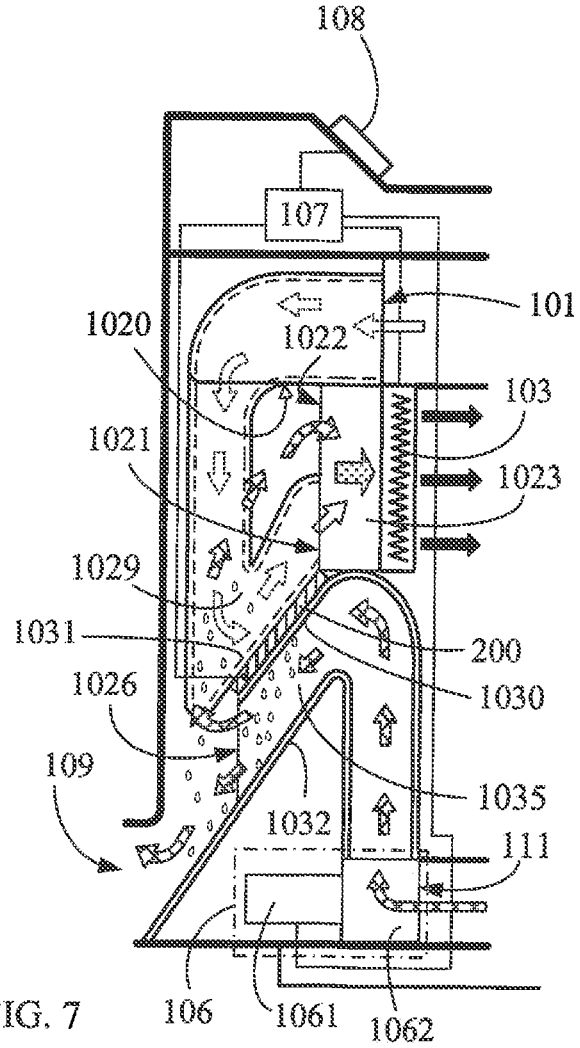
FIG. 7 is a schematic structural view showing the pipeline structure (1029) of the inlet/outlet temperature difference water condensing and heat refluxing device (102) being installed with the thermoelectric cooling chip (200), according to one embodiment of the present invention.

FIG. 7 is a schematic structural view showing the water condensing pipeline structure (1029) of the inlet/outlet temperature difference water condensing and heat recycling device (102) being installed with the thermoelectric cooling chip (200), according to one embodiment of the present invention.

As shown in FIG. 7, the thermoelectric cooling chip (200) controlled by the electronic control device (107) is installed in the hot air section of the water condensing pipeline structure (1029) or inside the pipeline, and the heating surface of the thermoelectric cooling chip (200) is provided for heating the cold air section of the water condensing pipeline structure (1029) allowing the external air to pass through, and the cooling surface of the thermoelectric cooling chip (200) is provided for cooling the hot air section of the water condensing pipeline structure (1029) which allows the hot air containing water to pass through, so when the hot air containing water pumped by the electric fluid pump (106) passes through the water condensing pipeline structure (1029) combined with the cooling surface of the thermoelectric cooling chip (200), the water condensing effect is increased, while the external air passing through the water condensing pipeline structure (1029) combined with the heating surface of the thermoelectric cooling chip (200) is heated.

Moreover, the fluid heating device (103) may be omitted from embodiments of the heat recycling drying machine utilizing inlet/outlet air temperature difference to condense water disclosed of the present invention in FIG. 1, FIG. 2, FIG. 3 and FIG. 4, and replaced by the thermoelectric cooling chip (200) disposed in the water condensing pipeline structure (1029), for increasing the water condensing effect to the hot air containing water passing through the hot air section of the water condensing pipeline structure (1029), and for heating the external air in the cold air section of the water condensing pipeline structure (1029).

Figure 8:
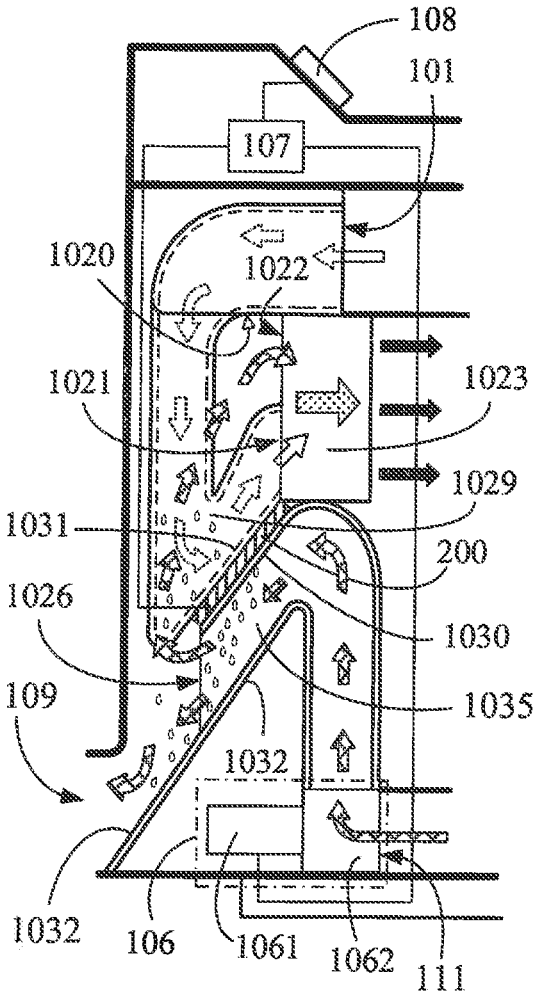
FIG. 8 is a schematic structural view showing the pipeline structure (1029) of the inlet/outlet temperature difference water condensing and heat refluxing device (102) being installed with the thermoelectric cooling chip (200) for replacing the fluid heating device (103), according to one embodiment of the present invention.

FIG. 8 is a schematic structural view showing the water condensing pipeline structure (1029) of the inlet/outlet temperature difference water condensing and heat recycling device (102) being installed with the thermoelectric cooling chip (200) for replacing the fluid heating device (103), according to one embodiment of the present invention.

As shown in FIG. 8, the thermoelectric cooling chip (200) controlled by the electronic control device (107) is installed in the hot air section of the water condensing pipeline structure (1029) or inside the pipeline, the heating surface of the thermoelectric cooling chip (200) heating the cold air section of the water condensing pipeline structure (1029) that allows the external air to pass through, and the cooling surface of the thermoelectric cooling chip (200) cooling the hot air section of the water condensing pipeline structure (1029) that allows the hot air containing water to pass through, so that when the hot air containing water pumped by the electric fluid pump (106) passes through the water condensing pipeline structure (1029) combined with the cooling surface of the thermoelectric cooling chip (200), the water condensing effect is increased while the external air passing through the water condensing pipeline structure (1029) combined with the heating surface of the thermoelectric cooling chip (200) is heated, thereby replacing the function of the fluid heating device (103) even though no fluid heating device (103) is installed.

FIG. 8 shows a heat recycling drying machine utilizing inlet/outlet air temperature difference to condense water that is installed with the thermoelectric cooling chip (200) and not provided with the fluid heating device (103), and in which a labyrinth type flow mixing functional structure or multiple grid flow mixing functional structure or multiple partition board flow mixing functional structure can be further installed in the cold/hot air mixing space structure (1023) for unifying the preheated mixed air; or a free rotation stir blade structure (1028) can be further installed in the cold/hot air mixing space structure (1023), so that the free rotation of the free rotation stir blade structure (1028) can stir the preheated and mixed air for being unified; or in which both structures can be installed.

Figure 9:
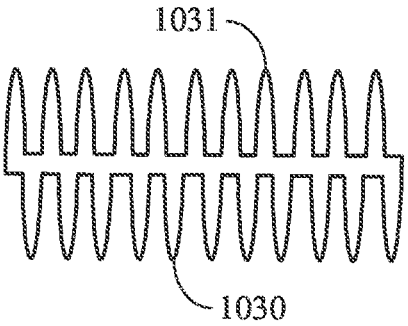
FIG. 9 is a cross view showing the internal and external parts of the pipeline structure (1029) being formed in fin-like shapes, according to one embodiment of the present invention.

According to the heat recycling drying machine utilizing inlet/outlet air temperature difference to condense water of the present invention, in the water condensing pipeline structure (1029) of the inlet/outlet temperature difference water condensing and heat recycling device (102), the contact surface in the cold air section of the water condensing pipeline structure (1029) which allows the external air to pass through, and the contact surface at the hot air section of the water condensing pipeline structure (1029) which allows the hot air containing water pumped by the electric fluid pump (106) to pass through, are further formed in fin-like shapes for increasing the water condensing function. FIG. 9 is a cross view showing the internal and external parts of the water condensing pipeline structure (1029) being formed in fin-like shapes, according to one embodiment of the present invention.

As shown in FIG. 9, in the water condensing pipeline structure (1029) of the inlet/outlet temperature difference water condensing and heat recycling device (102), the contact surface in the cold air section of the water condensing pipeline structure (1029) which allows the external air to pass through, and the contact surface in the hot air section of the water condensing pipeline structure (1029) which allows the hot air containing water pumped by the electric fluid pump (106) to pass through, are formed in fin-like shapes for increasing the water condensing function.

Figure 10:
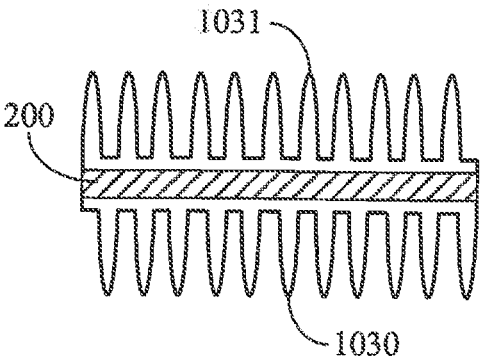
FIG. 10 is a cross view showing the internal and external parts of the pipeline structure (1029) being installed with the thermoelectric cooling chip (200), according to one embodiment of the present invention.

FIG. 10 is a cross view showing the internal and external parts of the water condensing pipeline structure (1029) being installed with the thermoelectric cooling chip (200), according to one embodiment of the present invention.

As shown in FIG. 10, the water condensing pipeline structure (1029) of the inlet/outlet temperature difference water condensing and heat recycling device (102) is further installed with the thermoelectric cooling chip (200), and the contact surface in the cold air section of the water condensing pipeline structure (1029) which allows the external air to pass through, and the contact surface at the hot air section of the water condensing pipeline structure (1029) which allows the hot air containing water pumped by the electric fluid pump (106) to pass through, are formed in fin-like shapes for increasing the water condensing function.

I claim:

1. A heat re-cycling drying machine, comprising:

an air intake flowpath (110);

a hot air pumping inlet (111);

a heating space (104) having a heating space inlet and a heating space outlet;

a cold/hot air mixing space structure (1023) having a relatively low temperature air intake port (1021) and a returned hot air intake port (1022) for mixing relatively low temperature air from the relatively low temperature air intake port (1021) with hot air from the returned hot air intake port (1022), the hot air having a temperature higher than a temperature of the relatively low temperature air, wherein the cold/hot air mixing space structure (1023) communicates with and is configured to supply a mixture of the hot air and the relatively low temperature air to the heating space (104) through the heating space inlet;

a relatively low temperature air pipeline structure (1029) including a relatively low temperature air inlet (101), a first relatively low temperature air passage having a vertically extending section, and an inclined second relatively low temperature air passage connected to the vertically extending section by a relatively low temperature air passage bent section, wherein the inclined second relatively low temperature air passage extends in a direction that forms a first acute angle with respect to the vertically extending section of the first relatively low temperature air passage, the relatively low temperature air inlet (101) is configured to input external relatively low temperature air from the air intake flowpath (110) to the first relatively low temperature air passage, in order for relatively low temperature air to be delivered to the relatively low temperature air intake port (1021), and in turn, for the relatively low temperature air to flow through the relatively low temperature air intake port (1021) to the cold/hot air mixing space structure (1023);

an electric fluid pump (106); and a hot air bent fluid pipeline (1035) connected to the hot air pumping inlet (111) and including a vertical first hot air passage, a downwardly inclined second hot air passage having an external outlet (109) at a lower end, a bend that joins the vertical first hot air passage with the downwardly inclined second hot air passage so that the downwardly inclined second hot air passage extends in a direction that forms a second acute angle with respect to the vertical first hot air passage, wherein the second acute angle and the first acute angle are configured so that the downwardly inclined second hot air passage extends parallel to and is separated from the inclined second relatively low temperature air passage of the pipeline structure (1029) by a shared thermally conductive structure formed by sidewalls of the downwardly inclined second hot air passage and the inclined second relatively low temperature air passage, the shared thermally conductive structure being configured such that thermal energy passes between the downwardly inclined second hot air passage and the inclined second relatively low temperature air passage, wherein the electric fluid pump (106) is configured to pump the hot air from at least one of the cold/hot air mixing space structure (1023) and the heating space (104) into the hot air bent fluid pipeline (1035) through the hot air pumping inlet (111) and cause said hot air to flow upwardly through the vertical first hot air passage, wherein the vertical first hot air passage, the downwardly inclined second hot air passage, and the second relatively low temperature air passage are configured such that the hot air that flows upwardly through the first hot air passage then passes through the bend and the downwardly inclined second hot air passage so as to transfer thermal energy between the downwardly inclined second hot air passage and the inclined second relatively low temperature air passage and cause water contained in the hot air to condense as a result of said transfer of thermal energy, flow downwardly through the downwardly inclined second hot air passage, and be discharged out of the external outlet (109), wherein the hot air bent fluid pipeline (1035) is further configured to cause a first portion of the hot air to be discharged from the external outlet (109), and to cause a second portion of the hot air that remains in the hot air passage after discharge of the first portion of the hot air to flow through the returned hot air intake port (1022) into the cold/hot air mixing space structure (1023) for mixing with the relatively low temperature air from the relatively low temperature air intake port (1021), and wherein a fluid heating device (103) is further installed between the cold/hot air mixing space structure (1023) and the heating space (104).

2. A heat re-cycling drying machine as claimed in claim 1, further comprising an electronic control device (107) for controlling operation of the electric fluid pump (106), in response to operation settings input through an external operation interface (108).

3. A heat-recycling drying machine as claimed in claim 1, further comprising an electronic control device (107) configured to control operation of the fluid heating device (103) in response to operation settings input through an external operation interface (108).

4. A heat-recycling drying machine as claimed in claim 1, further comprising:

an electric clothes dryer drum device (1040) for receiving articles or clothes to be dried; and a drum driving motor set (105) for rotatably driving the drum device;

wherein the heating space (104) is the electric clothes dryer drum device (1040), the heating space inlet is a drum device air inlet, and the heating space outlet is a drum device air outlet; and wherein the fluid heating device (103) is between the cold/hot air mixing space structure (1023) and the drum device air inlet, and is configured to re-heat mixed relatively low temperature and hot air passing from the cold/hot air mixing space structure (1023) to the drum device (1040) through the drum device air inlet, the re-heated air being recirculated through the drum device air outlet to the hot air pumping inlet (111).

5. A heat-recycling drying machine as claimed in claim 4, further comprising an electronic control device (107) configured to control operation of the drum device (1040) in response to operation settings input through an external operation interface (108).

6. A heat-recycling drying machine as claimed in claim 1, wherein surfaces of the second relatively low temperature air passage of the pipeline structure (1029) and the upwardly inclined second hot air passage of the bent fluid pipeline (1035) are configured as fin structures to increase a surface area contacted by passing air and thus enhance transfer of heat between internal pipeline structures of the inclined second relatively low temperature air passage and the inclined second hot air passage to enhance water condensation.

7. A heat-recycling drying machine as claimed in claim 1, wherein the drying machine is a dehumidifier.

8. A heat-recycling drying machine as claimed in claim 7, wherein surfaces of the second relatively low temperature air passage of the pipeline structure (1029) and the upwardly inclined second hot air passage of the bent fluid pipeline (1035) are configured as fin structures to increase a surface area contacted by passing air and thus enhance transfer of heat between internal pipeline structures of the inclined second relatively low temperature air passage and the inclined second hot air passage to enhance water condensation.

9. A heat-recycling drying machine as claimed in claim 1, further comprising a static flow unifying structure (1027) installed between the cold/hot air mixing space structure (1023) and the fluid heating device (103).

10. A heat-recycling drying machine as claimed in claim 1, further comprising a free rotation stir blade structure (1028) installed between the cold/hot air mixing space structure (1023) and the fluid heating device (103).

* * * * *